United States Patent [19]

Belza

[11] 4,010,510

[45] Mar. 8, 1977

[54] PAINT BRUSH AND THE LIKE

[76] Inventor: George S. Belza, 22 Carney Road, Willowdale, Ontario, Canada, M2M 1T2

[22] Filed: Mar. 12, 1976

[21] Appl. No.: 666,276

[52] U.S. Cl. ..... 15/192; 15/186; 300/21

[51] Int. Cl.[2] ..... A46B 3/02

[58] Field of Search ..... 15/159 R, 159 A, 191–193, 15/186, 187; 300/21

[56] References Cited

UNITED STATES PATENTS

| | | | |
|---|---|---|---|
| 2,258,361 | 10/1941 | Hewes | 15/192 |
| 2,790,986 | 5/1957 | Schwartz et al. | 15/195 X |
| 2,887,340 | 5/1959 | Veneko | 15/159 A |
| 3,111,699 | 11/1963 | Comeau | 300/21 X |
| 3,871,048 | 3/1975 | Leigh | 15/193 X |

FOREIGN PATENTS OR APPLICATIONS

| | | | |
|---|---|---|---|
| 1,248,576 | 11/1960 | France | 15/193 |

*Primary Examiner*—Peter Feldman
*Attorney, Agent, or Firm*—Rogers, Bereskin & Parr

[57] ABSTRACT

A paint brush is described. The brush has a handle and a ferrule secured to the handle. The brush also includes a plurality of bristles having inner end portions received within the ferrule and outer end portions which project from the ferrule. A bristle setting material retains the bristles within the ferrule. A plurality of elongate spacer elements are arranged inside the ferrule generally parallel to the inner end portions of the bristles. The bristles and spacer elements are tightly packed in the ferrule and the spacer elements are distributed between the bristles so as to mechanically and positively space the bristles and provide a predetermined bristle density. Paint brush manufacturing methods are also described.

13 Claims, 7 Drawing Figures

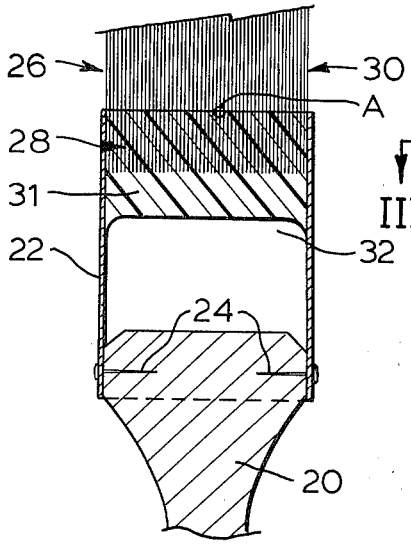
FIG. 1
FIG. 2
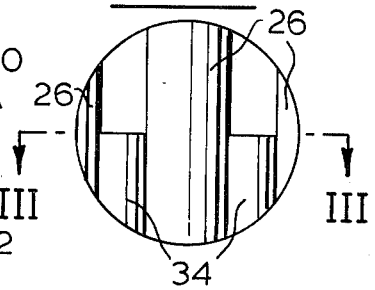
FIG. 3
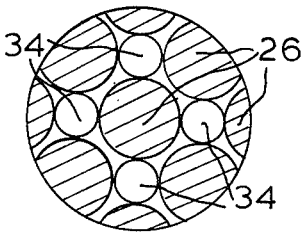
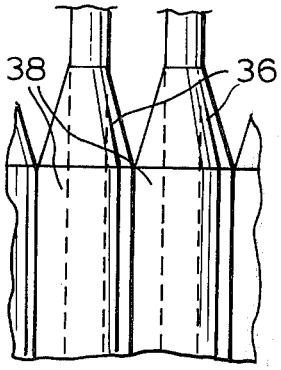
FIG. 4
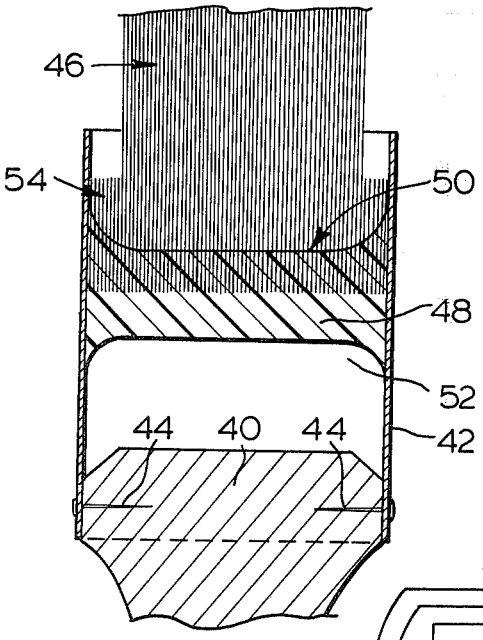
FIG. 5
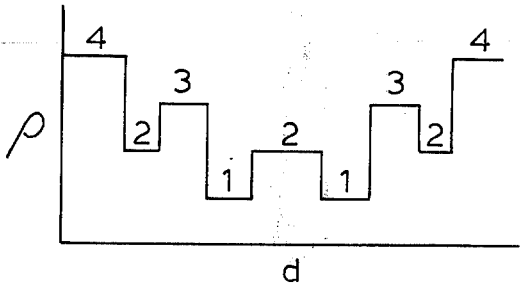
FIG. 7
FIG. 6
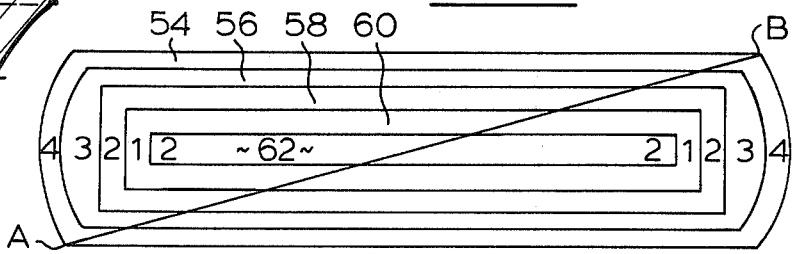

PAINT BRUSH AND THE LIKE

This invention relates to paint brushes and the like.

A conventional flat brush normally includes two or more of groups of tightly packed bristles set in a metal band or ferrule attached to a handle. The groups of bristles are separated by wood or fibre strips intented to promote bristle flexibility and reduce the amount of bristle required. The strips define between the bristle groups "wells" which are intended to assist both paint penetration when the brush is in use and solvent penetration during cleaning of the brush. However, a problem is that a brush of this type has poor paint retention characteristics when in the bristle-down position. This is because, in the bristle-down position, there is no restriction on the flow of paint from the wells. Also, when the brush is manipulated in use, movement of the bristles tends to force paint outwardly from the wells, causing the bases of the bristles to become loaded with excess paint. This paint then is liable to run down the outside of the ferrule of the brush.

Other disadvantages of this conventional arrangement are that the tightly packed bristles make it difficult to effectively and thoroughly clean between the bristles in the groups; this leads to the formation of hardened paint bone. Also, it is difficult for the manufacturer to readily determine the working characteristics of the brush such as the degree of bristle flexibility, brisle bulk and the quantity and distribution of paint load.

It has previously been proposed to provide a paint brush in which the bristles are not tightly packed. Canadian Pat. No. 653,763 Dec. 11, 1962 discloses a paint brush in which the bristles are loosely packed at their root ends in a setting compound. However, such brushes are manufactured by a technique which offers no precise control over bristle density.

U.S. Pat. No. 1,333,146 discloses a spraying brush having sets of bristles in which the sets at the perimeter of the brush are positioned close together to retard outward movement of liquid. However, in this case, the bristles in the individual sets are tightly packed, as a result of which the brush would exhibit the disadvantages associated with tightly packed bristles as described above.

An object of the present invention is to provide an improved paint brush and the like having a facility for precise control of bristle density.

According to the invention the brush and the like includes a handle and a ferrule secured to the handle. The brush also includes a plurality of bristles having inner end portions received within the ferrule and outer end portions which project from the ferrule. A bristle setting material retains the bristles within the ferrule. A plurality of elongate spacer elements are arranged inside the ferrule generally parallel to the inner end portions of the bristles. The bristles and spacer elements are tightly packed in the ferrule and the spacer elements are distributed between the bristles so as to mechanically and positively space the bristles and provide a pre-determined bristle density.

The invention will be better understood by reference to the accompanying drawings which illustrate a number of embodiments of the invention by way of example. In the drawings:

FIG. 1 is a somewhat diagrammatic vertical cross-sectional view taken generally longitudinally of a paint brush according to the invention;

FIG. 2 is an enlarged view of the part of the brush indicated at A in FIG. 1;

FIG. 3 is a cross-sectional view generally on line III—III of FIG. 2;

FIG. 4 is a view similar to FIG. 2 according to an alternative embodiment of the invention;

FIG. 5 is a view similar to FIG. 1 according to a still further embodiment;

FIG. 6 is a diagrammatic plan view corresponding to FIG. 5; and,

FIG. 7 is a graph which illustrates the bristle density at different parts of the brush of FIGS. 5 and 6.

Reference will first be made to FIG. 1 which shows a paint brush including a wooden handle 20 fitted with a metal ferrule 22. Ferrule 22 extends around the upper end portion of the handle 20 and is secured thereto by nails 24. A plurality of bristles 26 are received within the ferrule. The bristles have inner or "butt" end portions 28 which are retained inside the ferrule, and outer end portions 30 which project from the ferrule.

The butt end portions 28 of the bristles 26 are embedded in an epoxy resin material inside the ferrule. This material also provides an epoxy base 31 below the bristles. The epoxy resin material is of a type conventionally used for this purpose in the paint brush art, although it is to be understood that other suitable setting materials may alternatively be used. An empty space 32 exists between the base 31 and the handle 20 as can be seen from FIG. 1.

FIG. 2 is an enlarged view of the portion of FIG. 1 indicated at A. It will be noted that the view is taken at the position of the upper edge of the ferrule 22. A number of bristles 26 are visible in FIG. 2. However, for convenience of illustration, FIG. 2 does not show bristles which would in fact appear behind the bristles 26 in a complete cross-sectional view; a number of these bristles are visible in FIG. 3.

In any event, FIGS. 2 and 3 show that the individual bristles 26 of the brush are separated from one another by spaced elements 34 which are interspread between the butt end portions 28 of the bristles inside the ferrule. The bristles and spacer elements are tightly packed and the spacer elements are distributed between the bristles so as to mechanically and positively space the same. The spacer elements are generally cylindrical stubs of synthetic bristle-like material. In this particular embodiment, the stubs are nylon. The stubs are also set in the epoxy material referred to above. As can be seen from FIG. 2, the stubs are all of a substantially similar length which is selected such that the stubs extend substantially to the position of the upper edge of the ferrule 22. For clarity of illustration, the stubs are not shown in FIG. 1.

The bristle/stub arrangement shown in FIG. 3 may be considered to be somewhat theoretical in that each bristle is separated from adjacent bristles by four stubs 34 equally spaced around the bristle. In practice, the stubs will normally be less precisely positioned. Also, it is to be noted that other bristle/stub arrangements are possible.

In one method of manufacturing a brush of the type described above, stubs and bristles in an appropriate pre-determined ratio (e.g. 1 to 1 or 2 to 1) are thoroughly intermixed and then set in the epoxy resin material by conventional brush making techniques.

In order to facilitate handling of the stubs, it may be desirable to use special stubs which are longer than the portions of the bristles which are set in the epoxy resin material. The stubs may be of any length which can conveniently be handled by conventional brush making machinery. In this event, the outer portion of each stub above the level of the epoxy material would be discarded after the stubs and bristle have been set in the ferrule. This may be achieved by making each stub in two parts joined by a so-called "weak link" which may be broken at the appropriate time to allow the outer end portion of the stub to be discarded. In other words, each stub would be made up of a short inner portion intended to be set in the epoxy material, and a somewhat longer outer portion which would ultimately be discarded. In one example, each stub could be in the form of a single uniform-diameter piece of material having a crimp between the two portions of the stub, which crimp would be designed to fail under severe mechanical vibration. In another example the weak link could be formed by a material which would disintegrate when exposed to moderate heat or to a specific chemical agent after the epoxy material has set. Alternatively, the outer end portion or even the whole of each stub could be arranged to disintegrate. In the latter case, holes would, of course, remain in the epoxy material after disintegration of the stubs, although the bristles would be held firmly by the epoxy material.

The technique for setting stubs of this type in the epoxy material is essentially the same as that described above. A predetermined number of complete stubs (each including both portions joined by a weak link) are thoroughly intermixed with a pre-determined number of bristles. It will of course be appreciated that the stubs will all be similarly oriented so that their inner end portions lie alongside the inner (butt) end portions of the bristles. The bristle/stub mixture is then set in the epoxy material in the normal fashion. Subsequently, the weak links in th stubs are broken (e.g. by subjecting the brush to severe vibration or to an appropriate chemical agent depending on the form of the weak link) and the outer portions of the stubs discarded.

FIG. 4 shows another embodiment of the invention in which specially manufactured nylon bristles are used. The bristles are denoted 36 in FIG. 4. In this case, spacer elements are provided in the form of integral enlargements on the bristles. As can be seen from FIG. 4, the butt end portion of each bristle 36 is provided with an integral enlargement 38 which co-operates with the enlargements on other adjacent bristles to space the outer end portions of the bristles as seen in FIG. 4. In conventional brush manufacturing methods, it is normal to pass the bristles through a die or the like so that the resulting bristles are slightly tapered. It is believed that this technique may be adapted to produce bristles with integral spacer formations as in FIG. 4. Bristles of this form may be manufactured from conventional synthetic bristle material. Alternatively, it may be possible to provide natural bristle or ordinary synthetic bristle with similar enlargements by means of a coating or encasing operation.

A brush of the kind described with reference to FIGS. 1 to 3 or with reference to FIG. 4 presents a number of advantages compared with a conventional brush in which groups of tightly packed bristles are separated by wood or fibre strips. A primary advantage is that the brush of the invention has improved paint retention characteristics and greater loading capacity. It is believed that two factors contribute to this. The first factor is the removal of the conventional wood or fibre strips to which paint can adhere only by surface tension. The second factor is an increase in the capillary action of the bristles. Another advantage is that of easier cleaning and longer life. There are no tightly packed bristles at the heel of the brush. The spaced bristle arrangement reduces the amount of residual paint which will accumulate at the inner ends of the bristle and promotes the entry of solvent. These factors retard the formation of hardened paint residue (paint bone) in the brush.

Also the invention allows the brush manufacturer precise control over the working qualities of the brush. The degree of bristle flexibility, the amount of bristle bulk and the quantity and distribution of the paint load can be controlled by varying the spacing of the bristles. This makes it possible to "custom design" a brush so that it has precisely the appropriate working characteristics for any application.

Reference will now be made to FIGS. 5 to 7 in describing a further embodiment of the invention. The brush shown in FIGS. 5 to 7 was designed with the object of further improving paint retention of the brush in the bristle-up position and controlling load distribution in all positions of the brush.

FIG. 5 shows a brush according to this embodiment of the invention. As in the case of the previous embodiments, the brush basically comprises a wooden handle 40, a metal ferrule 42 attached to the handle by nails 44 and bristles 46 set in the ferrule. The bristles are set in an epoxy material which also provides an epoxy base 48. The epoxy material in which the bristles are embedded extends to a position represented by the line denoted 50. Numeral 52 denotes an empty space between the epoxy base 48 and the handle 40. As in the previous embodiments bristle density (see later) is controlled by spacer stubs mixed in with the bristles, although bristles having integral spacer elements as described with reference to FIG. 4 could obviously be used instead. However, for clarity of illustration, the actual stubs are not shown; in principle, FIGS. 2 and 3 also apply to this embodiment.

FIG. 6 is a diagrammatic representation of the bristles 46 of FIG. 5 when viewed in plan view. The bristles are arranged in four annular layers 54, 56, 58 and 60 around a centre layer 62. The bristle density varies from layer to layer as will be explained so as to, in effect, form wells in the bristle to assist paint retention and discourage unwanted migration of paint.

As can be seen from FIG. 5, the bristles in the outer layer 54 are shorter than the bristles in the inner layers. Also, the bristles in layer 54 are somewhat stiffer. It will be noted from FIG. 5 that the ferrule 42 is extended above the outer ends of the bristles in layer 54. This avoids paint running down the outside of the ferrule. Further, it will be noted that the upper surface of the epoxy material as denoted by line 50 is dished so as to taper upwardly towards the inner surface of the ferrule. Accordingly, any paint entering the outer bristle layer 54 will tend to flow inwardly of the bristles.

Referring now to FIG. 6, the numerals 1, 2, 3 and 4 represent different bristle densities. The lower numbers indicate lowest density bristle. These differing bristle densities are represented in graph form in FIG. 7. The graph indicates the densities as different positions along the diagonal line AB in FIG. 6. The abscissa of the graph represents the distance d of points on AB measured from point A and the ordinate represents $\rho$.

It will be seen that the layer of greatest density is the outer layer 54 and that there are in effect two wells in the bristles formed by low density layers 56 and 60, both of which are bordered by layers of higher density bristles. These wells tend to retain paint within the bristles and impede outward migration of paint and may in effect attract paint from areas of higher bristle density.

The different bristle densities are achieved by varying the diameters of the spacers in different layers. A similar effect can be achieved using specially made bristles of the kind indicated in FIG. 4. In this case it is necessary to provide a range of bristles with different diameter enlargements to provide the density variation. In any event, the layers are produced during the manufacture of the brush by successive "casing" operations. Casing is a conventional operation which is well known in the brush making art. This operation is merely repeated an appropriate number of times usin different materials to produce the required multi-layer bristle structure.

Finally, it should be noted that the preceding description applies to specific embodiments and that many modifications are possible within the broad scope of the invention. For example, the invention may be applied to brushes other than those of the specific shapes shown in the drawings. Also it is to be noted that although this application refers primarily to paint brushes, there is no limitation in this and that the invention may be applied to any brush used to apply liquids. Variations in handle design and in the method of "setting" the bristles are also possible as is well known in the art. The term "ferrule" as used in this application includes any structure in the nature of a band or the like which defines a space to receive bristles. The bristles themselves may be of any type conventionally used in the paint brush art and may be natural or synthetic. Also, features of the invention described in connection with the embodiment of FIGS. 5 to 7 may be applied to the preceding embodiments. Finally it is to be understood that the specific bristle density distribution described with reference to these FIGURES is an example only and is not limitive.

What I claim is:

1. A paint brush and the like comprising:

a handle, a ferrule secured to the handle;

a plurality of bristles having inner end portions received within the ferrule and outer end portions which project from the ferrule;

a bristle setting material retaining the bristles within the ferrule;

a plurality of elongate spacer elements arranged inside the ferrule generally parallel to the inner end portions of the bristles and extending in length to substantially the level of said setting material, the bristles and spacer elements being tightly packed in the ferrule and the spacer elements being distributed between the individual bristles so as to mechanically and positively space the bristles and provide a predetermined bristle density.

2. A brush as claimed in claim 1, wherein the spacer elements are in the form of elongate, generally cylindrical stubs of a synthetic material.

3. A brush as claimed in claim 1, wherein the spacer elements are integrally formed on the inner end portions of the bristles, each element comprising an annular enlargement of the relevant bristle.

4. A brush as claimed in claim 1, wherein the spacer elements are formed on the inner end portions of the bristles, each element comprising an enlargement applied to said inner end portion of a normal bristle.

5. A brush as claimed in claim 1, wherein the bristles include an outer layer in which the bristles are shorter than the remaining bristles in the brush, and wherein the ferrule extends to a position beyond the outer ends of said shorter bristles.

6. A brush as claimed in claim 1, wherein said bristle setting material defines a dished upper surface having marginal portions which taper upwardly adjacent the ferrule.

7. A paint brush as claimed in claim 1, wherein the spacer elements are in the form of elongate, generally cylindrical stubs of a synthetic material intended to disintegrate under predetermined conditions, whereby the stubs may be removed by subjecting them to said conditions, to leave the bristles set in said material.

8. A paint brush and the like comprising:

a handle;

a ferrule secured to the handle;

a plurality of bristles having inner end portions which project from the ferrule;

a bristle setting material retaining the bristles within the ferrule in positions determined during manufacture of the brush by a plurality of elongate spacer elements of a material intended to disintegrate under predetermined conditions, the elements being arranged inside the ferrule generally parallel to the inner end portions of the bristles during setting of the bristles and the spacer elements being tightly packed with and distributed between the individual bristles to provide a predetermined bristle density, said elements extending in length to substantially the level of said setting material, said elements being subsequently subjected to said predetermined conditions causing the spacer elements to disintegrate and leave the bristles set in said bristle setting material.

9. A paint brush and the like comprising:

a handle;

a ferrule secured to the handle;

a plurality of bristles having inner end portions received within the ferrule and outer end portions which project from the ferrule;

a bristle setting material retaining the bristles in the ferrule;

a plurality of elongate spacer elements arranged inside the ferrule for determining bristle density, the bristles and spacer elements being tightly packed in the ferrule and the spacer elements being disposed generally parallel to the inner end portions of and distributed between the individual bristles so as to mechanically and positively space the bristles, the spacer elements extending in length to substantially the level of said setting material;

the bristles being arranged in a plurality of annular layers around a center layer, at least some of said layers being of different densities so as to define at least one annular paint retaining well in the brush.

10. A brush as claimed in claim 9, wherein said bristle setting material defines a dished upper surface having marginal portions which taper upwardly adjacent the ferrule.

11. A method of manufacturing a paint brush as claimed in claim 1, the method comprising the steps of:

providing a plurality of bristles having inner end portions and outer end portions; and a plurality of elongate spacer elements;

arranging the inner end portions of the bristles and the spacer elements within a ferrule attached to a handle with the elements disposed generally parallel to the inner end portions of the bristles, the bristles and spacer elements being tightly packed in the ferrule and the spacer elements being distributed between the individual bristles so as to mechanically and positively space the bristles and provide a predetermined bristle density; and setting the bristles and spacer elements in a bristle setting material within the ferrule, said spacer elements being set in said setting material to extend in length to substantially the level of said setting material.

12. A method as claimed in claim 11, wherein each spacer element includes an inner end portion, an outer end portion, and a weak link joining said portions, said link being designed to fail under predetermined conditions and the elements being arranged inside the ferrule with said inner end portions adjacent the inner end portions of the bristles, and wherein the method further comprises the additional step of:

subjecting the spacer elements to said predetermined conditions to cause said weak links to fail, and discarding said outer end portions of the spacer elements.

13. A method as claimed in claim 11, wherein each of said spacer elements includes an inner end portion and an outer end portion, the spacer elements being arranged with said inner end portions adjacent the inner end portions of the bristles, and at least the outer end portions of the spacer elements being of a material intended to disintegrate under predetermined conditions, and wherein the method further comprises step of:

subjecting the spacer elements to said predetermined conditions to cause at least the outer end portions of the elements to disintegrate.

* * * * *